US008464891B2

(12) United States Patent
Pico et al.

(10) Patent No.: US 8,464,891 B2
(45) Date of Patent: Jun. 18, 2013

(54) HOT/COLD CONTAINER AND LID

(76) Inventors: Merissa Beth Pico, Fort Lee, NJ (US); Deborah Pico, Fort Lee, NJ (US)

( * ) Notice: Subject to any disclaimer, the term of this patent is extended or adjusted under 35 U.S.C. 154(b) by 232 days.

(21) Appl. No.: 12/387,310

(22) Filed: Apr. 30, 2009

(65) Prior Publication Data

US 2010/0276430 A1 Nov. 4, 2010

(51) Int. Cl.
*B65D 1/36* (2006.01)

(52) U.S. Cl.
USPC ..... 220/553; 220/62.18; 220/528; 220/592.2; 220/677

(58) Field of Classification Search
USPC ..... 220/553, 502, 62.18, 915.1, 592.2, 220/592.25, 592.27, 62.11, 677, 689, 666, 220/682; 222/1, 129; 206/586, 453
See application file for complete search history.

(56) References Cited

U.S. PATENT DOCUMENTS

| | | | | |
|---|---|---|---|---|
| 5,695,270 | A * | 12/1997 | Collet | 362/34 |
| 5,882,612 | A * | 3/1999 | Riley | 422/300 |
| 5,896,641 | A * | 4/1999 | Yamada et al. | 29/455.1 |
| 6,029,457 | A | 2/2000 | Neeser | |
| 6,142,332 | A | 11/2000 | Ferrara | |
| 6,318,114 | B1 | 11/2001 | Slaughter | |
| 6,557,368 | B1 | 5/2003 | DeMars | |
| 6,868,980 | B2 * | 3/2005 | Schultz et al. | 220/367.1 |
| 6,938,436 | B2 | 9/2005 | Roth | |
| 6,938,793 | B2 | 9/2005 | Lerner | |
| 7,051,550 | B2 | 5/2006 | Roth | |
| 7,380,412 | B2 | 6/2008 | Roth | |
| 2004/0069789 | A1 * | 4/2004 | Ohno et al. | 220/592.2 |
| 2005/0121356 | A1 * | 6/2005 | Wisecarver | 206/586 |
| 2008/0006642 | A1 | 1/2008 | Hidary | |
| 2008/0272132 | A1 * | 11/2008 | Afflerbach et al. | 220/682 |
| 2008/0310101 | A1 * | 12/2008 | Pawlenko et al. | 361/689 |
| 2009/0218360 | A1 * | 9/2009 | Suk | 220/784 |
| 2009/0321440 | A1 * | 12/2009 | Fedusa et al. | 220/62.18 |

OTHER PUBLICATIONS

Web-site printout from www.marcopromotionalproducts.com for EZ FREEZE Square Food Storage Container dated Jan. 9, 2009 (3 pages).
Web-site printout from www.imprintitems.com for Tradeshow give-away EZ FREEZE dated Jan. 9, 2009 (2 pages).
Web-site printout from www.organize.com for Chop and Store Set by Progressive dated Jan. 21, 2009 (2 pages).
Web-site printout from www.coolgearinc.com for EZ-FREEZE Standard Storage dated Jan. 12 and 21, 2009 (5 pages).

* cited by examiner

*Primary Examiner* — J. Gregory Pickett
*Assistant Examiner* — Raven Collins
(74) *Attorney, Agent, or Firm* — Keene IP Law, LLC

(57) ABSTRACT

A hot/cold container and lid is described. The container comprising: a bottom plate; a plurality of inner walls extending substantially perpendicular to said bottom plate, forming a hollow, therebetween; a plurality of outer walls extending substantially perpendicular to the bottom plate and substantially parallel to, and spaced from, a corresponding one of the inner walls, the spacing forming a compartment between the inner and outer walls, wherein corresponding ones of the inner and outer walls are attached at selected points between the inner and outer walls to provide at least one substantially uninterrupted compartment, therebetween. The Lid may be of a transparent, semi-transparent or opaque material and may be of a material that operates as a cutting board.

16 Claims, 4 Drawing Sheets

HOT/COLD CONTAINER AND LID

BACKGROUND OF THE INVENTION

Containers for the storage of foods in refrigerator and/or freezer compartments of refrigerator units or in dedicated freezer units is well-known in the art. Such containers are typically made of a glass or plastic material, as these materials are able to operate over a significant range of temperatures. For example, PYREX® is a well-known material that is advertised to assist in food preparation in allowing a PYREX® container to be transferred directly from a refrigerator or freezer to a microwave, a convection or a pre-heated conventional oven to have the contained foodstuffs prepared. PYREX® is a registered trademark of Corning Incorporated, New York. In some applications, plastic containers may similarly be used to take food stuffs in a relatively cold or frozen condition from the refrigerator or freezer, respectively, to the oven.

In some cases, plastic containers have an advantage over glass containers as the plastic containers are lighter to transport and are generally unbreakable.

When the food stuffs are not totally frozen, there arises situations wherein relatively cold food stuffs need to be transferred from one location to another while maintaining the foodstuffs in a relatively cold state. Typically, the food stuffs are placed in thermo containers along with a cooling material (e.g., bags of ice and/or frozen gel packs). The cooling materials generally lower the temperature of the interior compartment of the thermo containers which is maintained for a relatively long time by the thermo-isolation characteristics of the thermo container.

However, the combination of the thermo container and the cooling material increases the weight of transporting the food stuffs.

Hence, there is a need in the industry for a container that provides for maintaining a relatively cold or heated state of contained foodstuffs. In addition, it would be advantageous if the container would be able to allow the contained foodstuffs to be transferred from its relatively cold (or hot) state to the microwave, convection and/or conventional oven, without having to transfer the foodstuffs to a different container.

SUMMARY OF THE INVENTION

As described herein, the embodiments of the present invention overcome one or more of the above or other disadvantages known in the art.

A hot/cold container is described. The container comprising: a bottom plate; a plurality of inner walls extending from said bottom plate, forming a hollow, therebetween; a plurality of outer walls extending from the bottom plate and substantially parallel to, and spaced from, a corresponding one of the inner walls, the spacing forming a compartment between the inner and outer walls, wherein corresponding ones of the inner and outer walls are attached at selected points between the inner and outer walls to provide at least one substantially uninterrupted compartment. In one aspect, cooling or heating packets may be inserted into the formed compartments to maintain the temperature of the hollow relatively cool or warm, respectively. A lid further provides a seal to retain contained foodstuffs within the hollow.

These and other aspects and advantages of the present invention will become apparent from the following detailed description considered in conjunction with the accompanying drawings.

It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein.

DETAILED DESCRIPTION OF THE INVENTION

Figure 1:
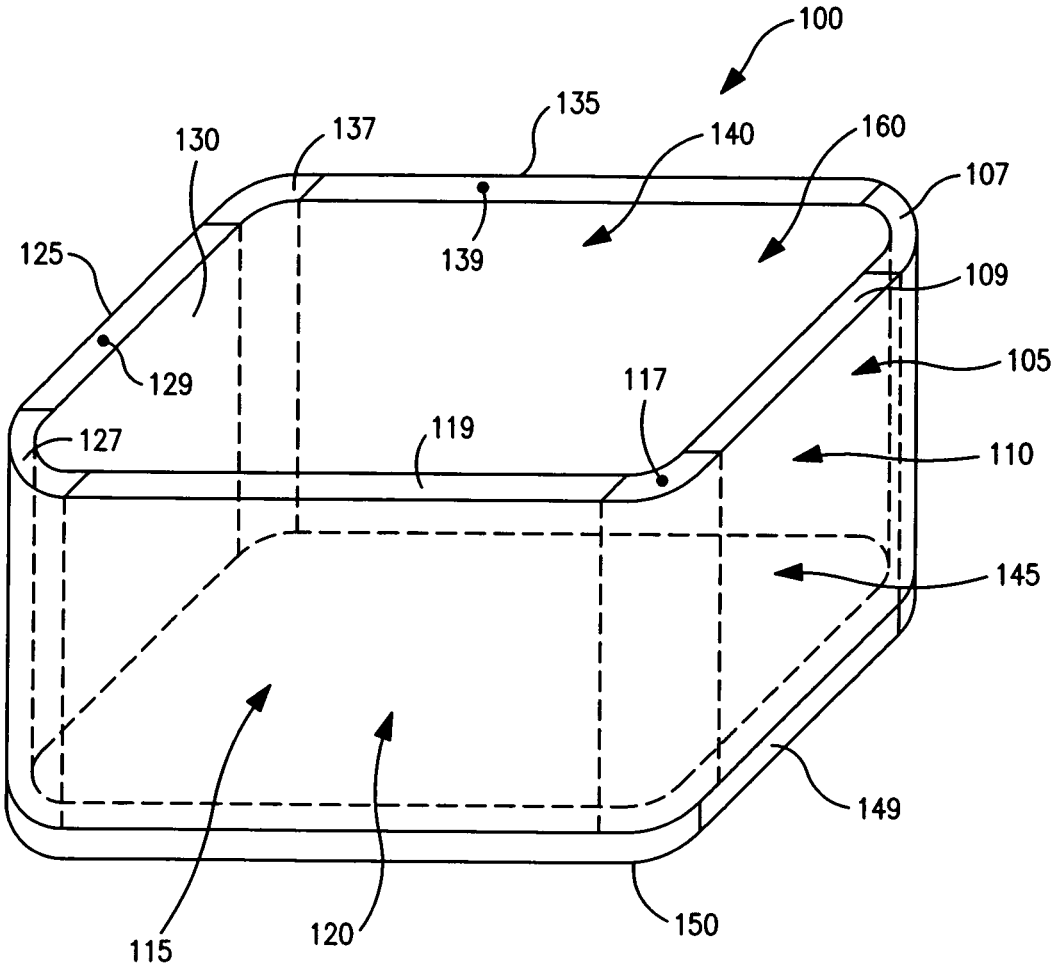
FIG. 1 illustrates a perspective view of an exemplary container in accordance with the principles of the invention.

FIG. 1 illustrates a perspective view of an exemplary container 100 in accordance with the principles of the invention. The container includes a plurality of outer walls 105, 115, 125 and 135 (shown as being substantially vertical) and corresponding inner walls 110, 120, 130 and 140, substantially parallel to the outer walls. The inner walls are arranged to form an interior compartment or hollow 160. The inner and outer walls are attached to a bottom section 150 having an upper surface 145. Surface 145 represents the bottom of the interior compartment or hollow 160. The outer walls 105, 115, 125 and 135 and corresponding inner vertical walls 110, 120, 130 and 140 are attached at selected points to provide at least one substantially uninterrupted space or compartment, therebetween. In this illustrated case the attachment of the inner and outer walls is at the intersection of corresponding walls (i.e. the corners). For example, a corner section 107 may represent an attachment point (i.e., one or more selected points of attachment between the inner and outer wall or a solid column) formed at the intersection of outer walls 105 and 135, and inner walls 110 and 140. Between the outer walls 105, 115, 125 and 135 and corresponding inner walls 110, 120, 130 and 140 and the solid corner columns 107, 117, 127 and 137 are formed compartments 109, 119, 129 and 139, respectively. Compartments 109, 119, 129 and 139 extend from a top edge of container 100 to at least the upper surface 145 of bottom 150.

Although it is illustrated that the inner and outer walls are attached at the corners it would be recognized that these attachments may also be made at different locations along the walls and even may only be at selected points positioned between the inner and outer vertical walls. The attachment at the corners is advantageous as it creates a large uninterrupted space between the inner and outer walls and provides rigidity of the container.

Also shown in FIG. 1 is opening 149 formed in bottom 150. Opening 149 enables access to a hollow or compartment (not shown) in bottom 150.

Figure 2:
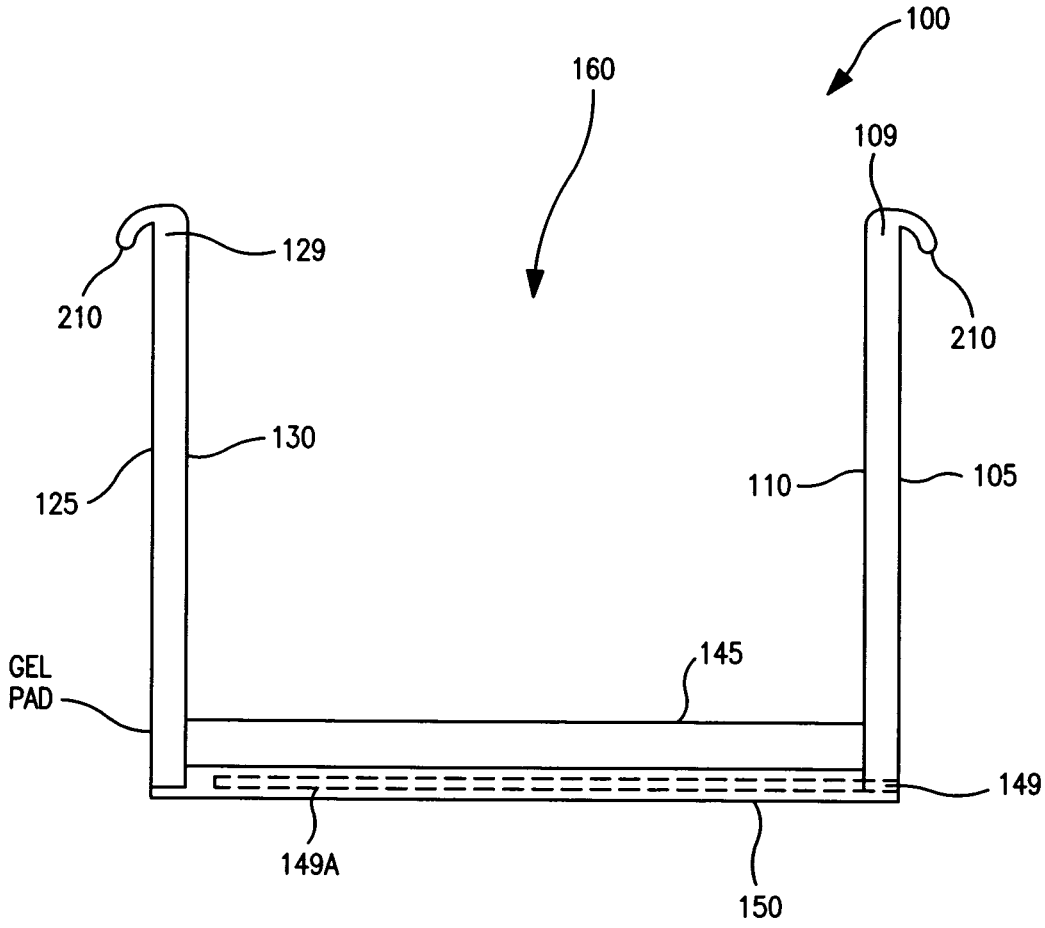
FIG. 2 illustrates a cross-sectional view of the exemplary container shown in FIG. 1.

FIG. 2 illustrates a cross-sectional view of container 100 shown in FIG. 1. As shown, a space or compartment 109 is formed between walls 105 and 110 extending from bottom plate 150 and a similar space or compartment 129 is formed between walls 125 and 130. These spaces are generally formed between the attachment points, which are shown in FIG. 1 as being at the corners or intersection of corresponding walls. Similarly, opening 149 allows access to compartment 149A formed in bottom 150. In one aspect of the invention, the compartment 149A formed in bottom 150 may be used to hold utensils, such as a knife, fork and/or spoon. In another aspect of the invention, the compartment may be used to contain a cooling or heating material.

Accordingly, in one aspect of the invention, four vertical and one horizontal compartments may be formed within container 100. It would be recognized that the container 100 shown herein represents a representative number of compartments that may be formed within container 100 and that a lesser number of compartments may be incorporated into container 100 without altering the scope of the invention claimed. For example, if the container were of a rounded shape, and not of the illustrated square (rectangular) shape, then the number of compartments may be determined based on a predetermined or desired size.

Also shown are lips 210 extending from the top of each of the outer walls 105 and 125. Lips 210 provide for a connection to retain a lid onto container 100 to maintain the contained food stuffs within the compartment or hollow 160.

Figure 3:
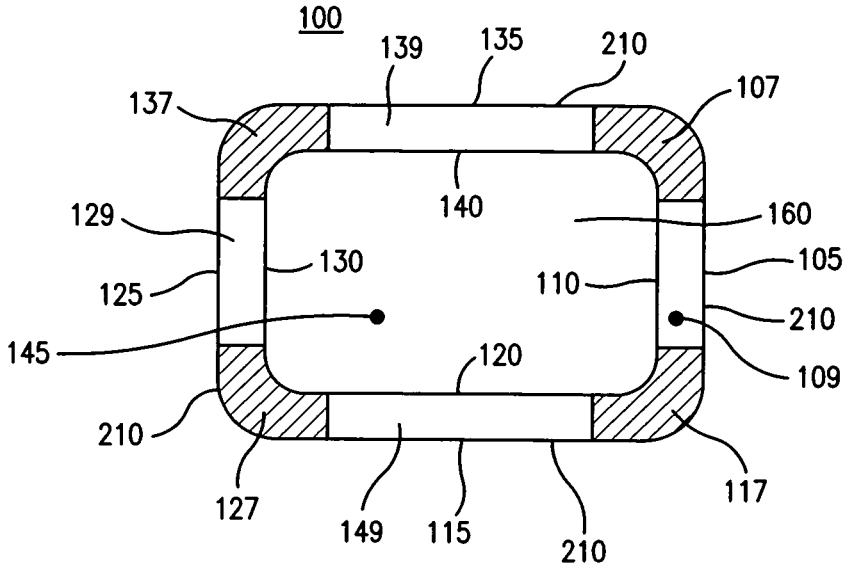
FIG. 3 illustrates a top view of the exemplary container shown in FIG. 1.

FIG. 3 illustrates a top view of the container 100 shown in FIG. 1 showing the solid connection 107, 117, 127 and 137 at the intersection of the corresponding walls. Also shown are lips 210 extending from the top edge of each of the outer walls 105, 115, 125 and 135.

In the embodiment of the invention shown in FIGS. 1-3, cooling materials, such as well-known cooling gel packs may be inserted in at least one compartment formed between the inner and outer walls or the horizontal compartment 149A to provide a relatively cold or cool temperature within compartment or hollow 160 of container 100.

As would be recognized, the space between corresponding inner and outer walls that form compartments 109, 119, 129 and 139 may be sized based on known cooling packet sizes or may be custom sized to accommodate cooling packet sizes that may be formed specifically for the desired function and size of the container. Similarly, compartment 149A in bottom 150 may be sized to accommodate known gel packets or custom sized gel packets.

The use of compartments 109, 119, 129 and 139 and 149A to retain corresponding cooling packets is advantageous as it allows for the insertion of cooling material packets when cooling is required and the removal of the cooling material packets when heating is required. Hence, the container may assist in food preparation from a cooling state to a heating state, as desired.

Although the invention has been described with regard to the terms "vertical" and "horizontal," it would be recognized by those skilled in the art at these terms are not to be considered absolute in the strict sense of the terms "vertical" and "horizontal." But rather, these terms are used to represent an orientation of the elements of the container wherein the walls may be extend from the bottom surface in a substantially perpendicular manner. In addition, it would be recognized that containers may be shaped such that the walls are angled outward (obtuse angle) from the bottom surface and in this case, the term "vertical" applies to such a container configuration. Hence, although FIGS. 1 and 2 illustrate a somewhat square or rectangular container having substantially vertical (perpendicular) walls with respect to the bottom surface, this illustration is merely to describe the invention claimed and that containers with inner and outer walls that extend at an obtuse angle with respect to the bottom surface are also contemplated and considered to be within the term "vertical," "substantially vertical" and "substantially perpendicular."

In addition, although FIGS. 1-3 illustrate a substantially square or rectangular container, it would be recognized by those skilled in the art that the container may be of a round, oblong, oval or elliptical shape. Such shapes are well-known in the art and need not be described or discussed herein. However, such shapes are also contemplated and are considered to be within the scope of the invention, as described by the claims.

Figure 4:
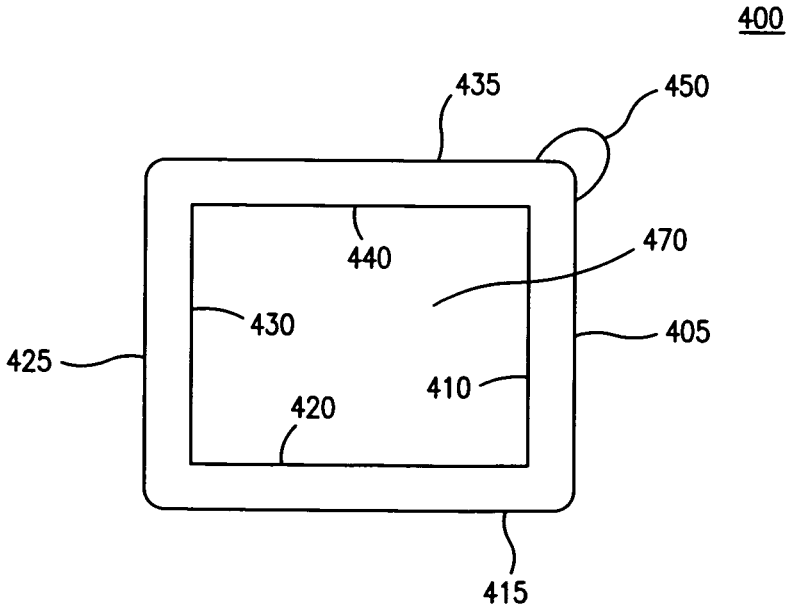
FIG. 4 illustrates a top view of an exemplary container lid in accordance with the principles of the invention.

FIG. 4 illustrates a top view of an exemplary lid 400 to cover the compartment or hollow 160 within container 100, shown in FIG. 1, in accordance with the principles of the invention. In this illustrative embodiment, lid 400 includes outer walls 405, 415, 425 and 435 which define the outer boundaries of lid 400. Within the outer boundaries are corresponding inner walls or protrusions 410, 420, 430 and 440. In one aspect of the invention, the outer walls 405, 415, 425 and 435 engage lip 210 on each of the corresponding outer walls 105, 115, 125 and 135 on container 100. In addition, the inner walls 410, 420, 430 and 440 are positioned adjacent to a corresponding inner wall within compartment or hollow 160.

Lid 400 further includes surface 470 enclosed by the outer edges. Surface 470 may be of transparent, semi-transparent or opaque material and may be of a material that operates as a cutting board. For example, surface 470 may be of a plastic material that may be different than or the same as the material that is used of the region outside of surface 470. Surface 470 may further include a region (not shown), upon which a user may use to write the user's name, the contents of the container and/or the date the contents of the container were placed in the container. The region may further be of a material different than that of surface 470 and may be erasable by washing, for example.

Also shown, is extension tab 450 attached to one corner of lid 400. Extension 450 may operate as a pull tab to remove lid 400 from container 100, Such pull tabs are known in the art and need not be described in detail herein.

Figure 5:
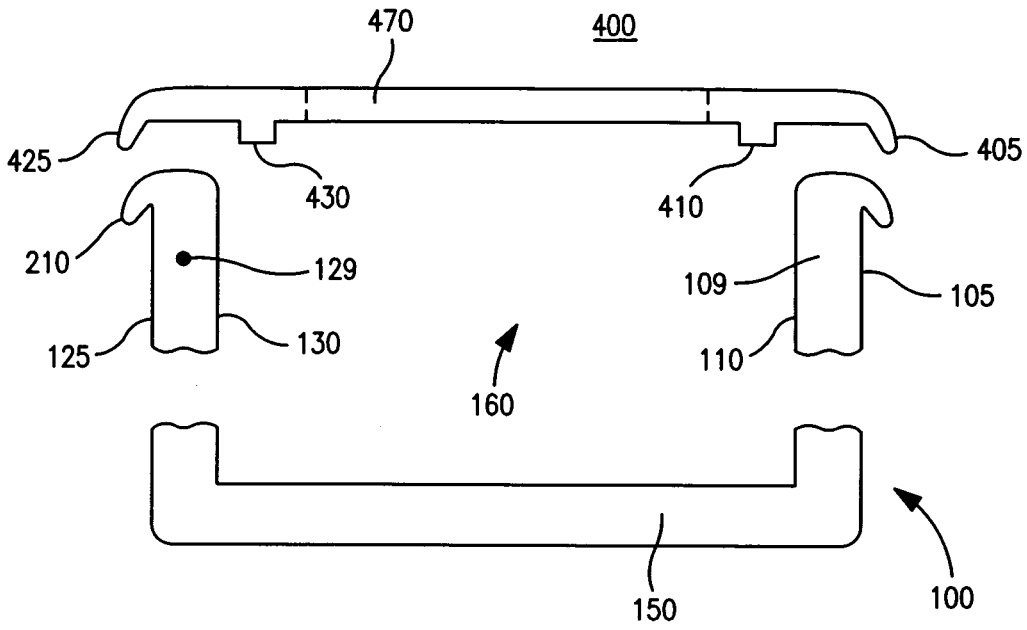
FIG. 5 illustrates a cross-sectional view of the exemplary container lid shown in FIG. 4.

FIG. 5 illustrates a cross-sectional view of lid 400 engaging container 100. In this illustrative aspect of the invention the outer edges 405, 425 of lid 400 are shown engaging lips 210 of container 100 to retain lid 400 onto container 100. Also shown is the positioning of inner walls 410 and 430 adjacent to corresponding inner walls 110 and 130, respectively. The positioning of inner walls 410 and 430 adjacent to corresponding container inner walls 110 and 130 provide a means for retaining the contained food stuffs within compartment or hollow 160. For example, liquids within compartment or hollow 160 are prevented from spilling into spaces 109 and 129 by the of appropriate position of walls 410 and 430 against inner walls 110 and 130, respectively. The length of the protrusions 410 and 430 may be determined based on a desired degree of sealing. The placement of lid 400 in a snug-fit attachment to container 100 is advantageous as it allows for the transportation of the contained food stuffs with little or no spillage. In another aspect of the invention, a significantly tight fit of lid 400 onto container 100 may allow for a seal of the lid 400 with the container 100 that would enable air within container 100 to be evacuated. In this case, lid 400 may include a means (e.g., a valve) that allows for air within container 100 to be partially withdrawn.

Although FIG. 5 illustrates the inner walls 410, 430 of lid 400 being placed adjacent to the corresponding inner walls 110, 130 within hollow 160, in another aspect of the invention, which is not shown, it would be recognized that the inner walls 410, 430 may be sized such that the inner walls protruding from lid 400 may be positioned within the space or compartment between corresponding inner walls (e.g., 110, 120, 130, 140) and outer walls (e.g., 105, 115, 125, 135). In this aspect of the invention, the inner walls (protrusions) 410, 430 may provide a tight seal to prevent spillage of food stuffs (e.g. liquids) from coming into contact with the gel packets.

Figure 6:
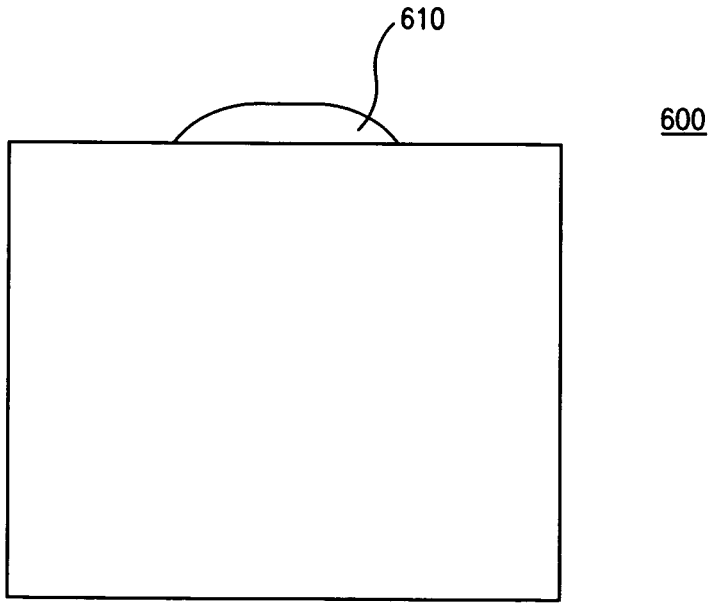
FIG. 6 illustrates an exemplary cooling packet in accordance with the principles of the invention.

FIG. 6 illustrates an exemplary cooling packet 600 which is sized to be contained within compartments 109, 119, 129 and 139 and/or horizontal compartment 149A. The cooling packet may be of a flexible material or a solid material. In either case, the cooling packet prevents the gel material contained therein from spilling out during freezing and warming cycles. Cooling packet 600 may include a non-toxic material similar to that contained in well-known freezer packs, such as RUBBERMAID BLUE ICE Mini Freezer Packs. Cooling packet 600 may further include a tab 610 that may be used to place control the removal of cooling packet 600 from a corresponding space or compartment (e.g., 109). RUBBERMAID and BLUE ICE are Trademarks of the Rubbermaid Corporation. Other types of gel materials may also be inserted into the components without altering the scope of the invention.

While there has been shown, described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, although the invention has been described with regard to cooling packets being inserted into the spaces or compartments formed between the inner and outer walls, it would be within the knowledge of those skilled in the art to incorporate heating packets within these spaces or compartments to maintain the temperature of the food stuffs at a higher temperature. Such heating packets may be brought to a desired temperature by microwaving the packets, for example, before being inserted into the compartments. The heat from the heating packets may thus be used to maintain the temperature of compartment or hollow 160 at a temperature that would allow the food stuffs to remain at a higher temperature. In one aspect, the heating packets may consist of hot water that is poured into the spaces between the vertical inner and outer walls and sealed by lid 400

It is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A container comprising:

a bottom plate;

four inner walls extending substantially perpendicular to said bottom plate, forming a hollow therebetween, the intersection of two adjacent inner walls forming an inner corner;

four outer walls extending substantially perpendicular to said bottom plate, said outer walls being substantially parallel to, and spaced a selected distance from said inner walls, the intersection of two adjacent outer walls forming an outer corner;

a columnar member attaching each inner corner to a corresponding outer corner, each columnar member extending along the entire length of each of said inner corner and said corresponding outer corner to provide at least four substantially uninterrupted compartments; and a space formed within said bottom plate, extending substantially through said bottom plate, wherein access to said space is made through an opening in one of said outer walls.

2. The container according to claim 1, further comprising: a lip attached to a top edge of each of said outer walls, said top edge being opposite said bottom plate.

3. The container according to claim 2, further comprising: a lid having a top surface and a bottom surface, said lid having a plurality of outer edges extending from said top surface, said outer edges engaging said lip attached to each of said top edges of said outer walls.

4. The container according to claim 3, wherein said lid further comprises: a plurality of protrusions extending from said bottom surface of said lid substantially parallel to said outer edges, each of said protrusions formed to fit adjacent to said inner walls of said container.

5. The container according to claim 4, wherein said protrusions fit adjacent to said inner walls adjacent to said hollow.

6. The container according to claim 4, wherein said protrusions fit adjacent to said inner walls between corresponding inner and outer walls.

7. The container according to claim 3, wherein said lid further comprises: means for extracting air from said hollow.

8. The container according to claim 1, wherein said inner and outer walls extend from said bottom plate at an obtuse angle with respect to said bottom plate.

9. The container according to claim 3, wherein said lid further comprises: a writable region.

10. The container according to claim 9, wherein said region is of a material that is erasable.

11. The container according to claim 1, wherein said bottom plate is rectangular.

12. The container according to claim 1, wherein said bottom plate is square.

13. A storage system, comprising:

a container, comprising:

a bottom plate;

four inner walls extending substantially perpendicular to said bottom plate, forming a hollow therebetween, the intersection of two adjacent inner walls forming an inner corner;

four outer walls extending substantially perpendicular to said bottom plate, said outer walls being substantially parallel to, and spaced a selected distance from said inner walls, the intersection of two adjacent outer walls forming an outer corner;

a columnar member attaching each inner corner to a corresponding outer corner, each columnar member extending along the entire length of each of said inner corner and said corresponding outer corner to provide at least four substantially uninterrupted compartments;

a space formed within said bottom plate, extending substantially through said bottom plate, wherein access to said space is made through an opening in one of said outer walls; and a lip attached to a top edge of each of said outer walls, said top edge being opposite said bottom plate; and a lid having a top surface and a bottom surface, said lid having a plurality of outer edges extending from said top surface, said outer edges engaging said lip attached to each of said top edges of said outer walls.

14. The system according to claim 13, wherein said lid further comprises: a plurality of protrusions extending from said bottom surface of said lid substantially parallel to said outer edges, each of said protrusions formed to fit adjacent to said inner walls of said container.

15. The system according to claim 14, wherein said protrusions fit adjacent to said inner walls adjacent to said hollow.

16. The system according to claim 14, wherein said protrusions fit adjacent to said inner walls between corresponding inner and outer walls.

* * * * *